US008557108B2

(12) United States Patent
Rennels

(10) Patent No.: US 8,557,108 B2
(45) Date of Patent: Oct. 15, 2013

(54) SANITARY INSERT FOR DRAIN

(76) Inventor: Kurt Rennels, Santa Clarita, CA (US)

( * ) Notice: Subject to any disclaimer, the term of this patent is extended or adjusted under 35 U.S.C. 154(b) by 414 days.

(21) Appl. No.: 13/039,901

(22) Filed: Mar. 3, 2011

(65) Prior Publication Data

US 2012/0222996 A1 Sep. 6, 2012

(51) Int. Cl.
*E03F 5/14* (2006.01)

(52) U.S. Cl.
USPC ..... 210/163

(58) Field of Classification Search
None
See application file for complete search history.

(56) References Cited

U.S. PATENT DOCUMENTS 3,714,733 A * 2/1973 Madonna ..... 43/121
4,190,910 A * 3/1980 Teglund et al. ..... 4/421
5,323,804 A * 6/1994 Lin ..... 137/362
5,481,766 A * 1/1996 Steadman ..... 4/661
6,319,397 B1 * 11/2001 Su et al. ..... 210/163
2004/0099586 A1 * 5/2004 Imoto ..... 210/85
2004/0128903 A1 * 7/2004 Wexler ..... 43/122
2004/0256298 A1 * 12/2004 Curtolo ..... 210/163
2011/0240536 A1 * 10/2011 Tseng et al. ..... 210/136
2012/0192950 A1 * 8/2012 Huber ..... 137/1
2012/0222996 A1 * 9/2012 Rennels ..... 210/163
2012/0241028 A1 * 9/2012 Kirk ..... 137/527

* cited by examiner

*Primary Examiner* — Robert James Popovics
(74) *Attorney, Agent, or Firm* — Michael N. Cohen; Cohen I.P. Law Group P.C.

(57) ABSTRACT

A removable drain inset apparatus for preventing drain flies from infesting a drain pipe is disclosed. The drain inset apparatus comprises a horizontal floor area having at least one drain hole positioned substantially on a center portion thereof. The drain insert apparatus further includes a slightly contoured wall surface extending upwardly from an outer peripheral edge of the horizontal floor area. The drain insert apparatus further includes a funnel portion extending downwardly from the at least one drain hole. The horizontal floor area further includes at least one ridge disposed on the top surface of the horizontal floor area for holding at least one grate.

10 Claims, 3 Drawing Sheets

SANITARY INSERT FOR DRAIN

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to sanitary inserts for sewer drains, and more particularly to a removable drain insert apparatus for preventing drain flies, algae and other microorganisms from infesting a sewage drain pipe.

DISCUSSION OF RELATED ART

Drain flies are tiny flies that commonly reproduce in slime, muck, or gelatinous film that often accumulates at the entrances to sewage pipes, particularly in restaurants and other environments where food is washed down the drain. The fly larva feed on the decaying organic matter, microorganisms, algae, and sediments in the media and become an unsanitary nuisance.

Simply pouring bleach or Drain-O™ down the drain is usually ineffective, since that does not adequately break up and digest all the organic matter that feeds the larva. Another solution is to pour hot water down the train to kill the fly larva. This method provides a short term solution because up to about 500 new eggs can almost immediately be laid in the media again by single female drain fly.

The drain can also be periodically cleaned with foam or gel that can kill the biological media that the larva feed on; or the media can be scraped off with a drain brush. However, this solution requires constant vigilance and repeated, periodic cleaning over short time intervals. It also requires the user to pour a toxin down the drainpipes. Finally, it is difficult to thoroughly clean and sanitize the drain pipes within the floor by using this method.

U.S. Pat. No. 7,735,512 issued to Ismert on Jun. 15, 2010 teaches a floor drain installation system that includes an adaptor attached to a drain pipe projecting from the ground; a coring sleeve with a bowl-shaped upper end attached to or integral with the adaptor; and a coring plug within the bowl of the receiver to close off the drain pipe during the pouring of a concrete floor, and to create a space for subsequent reception of a drain head and grate.

U.S. Pat. Application No. 20070209109 issued to Meyers on Sep. 13, 2007 teaches a floor drain that includes a drain body with a generally rectangular upper portion defining an inlet and a circular lower portion defining an outlet; a generally rectangular drain grate inserted into the inlet of the drain body; and a grout rim, supported by the drain body and surrounding the drain grate.

U.S. Pat. Application No. 20080189926 issued to Luxton on Aug. 14, 2008 teaches a flexible-wet-floor waste drain for engagement with a flexible waterproof floor covering material, comprised of a waste body, a waste-water inlet for the passage of waste water into the waste body, a waste-water outlet connecting the waste body to a drain, a means for engaging flexible waterproof floor covering material with the waste; and a tiling adaptor. The tiling adaptor includes an adaptor body having an upper surface with a perimeter edge for lying flush or substantially flush with an upper surface of adjacent or abutting tiles; an aperture formed in the adaptor body to direct liquid to the waste-water inlet, and a means for directly or indirectly engaging the body of the tiling adaptor with the waste body. A single kind of waste drain can thus be used with both tiles and flexible waterproof floor covering material.

The removable drain inserts or systems described above are complex, expensive and not user-friendly. Some of these systems are not designed to terminate the growth of drain flies, algae and other microorganisms. Moreover, some of these systems include moving parts and are difficult for cleaning and installation.

Therefore there is a need for a removable drain insert apparatus to prevent drain flies, algae and other microorganisms from infesting a drain pipe. Such an apparatus would be simple, inexpensive and user-friendly. This apparatus would contain no moving parts, be simple to install and easy to clean. The present invention accomplishes all these objectives.

SUMMARY OF THE INVENTION

The present invention provides a removable drain insert apparatus for preventing drain flies, algae and other microorganisms from infesting a drain pipe. The removable drain insert apparatus includes a horizontal floor area having at least one drain hole positioned substantially on a center portion thereof. The drain insert further includes a slightly contoured wall surface extending upwardly from an outer peripheral edge of the horizontal floor area and a funnel portion extending downwardly from at least one drain hole. The funnel portion may be tapered in shape. The funnel portion may be adapted to receive a pipe inlet of a floor sink/sewage ingress to drain water and the horizontal floor area may collect solid waste that can be dumped out during cleaning The horizontal floor area further includes at least one ridge disposed on a top surface of the horizontal floor area for holding at least one grate. The removable drain insert apparatus further includes at least one hand grip attached to at least one corner portion of the horizontal floor area. The at least one hand grip may be adaptable to remove the removable drain insert apparatus from the floor sink/sewage ingress when not in use.

DETAILED DESCRIPTION OF THE PREFERRED EMBODIMENT

Figure 1:
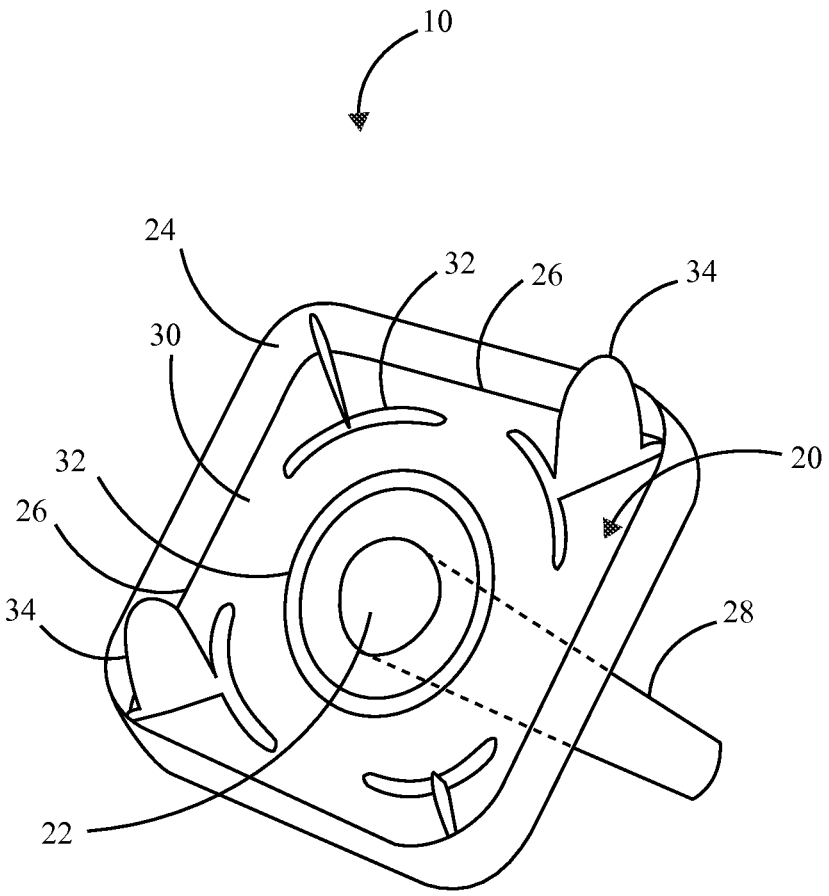
FIG. 1 is a perspective view of a removable drain insert apparatus.

FIG. 1 is perspective view of a removable drain insert apparatus 10 for preventing drain flies, algae and other microorganisms from infesting a drain pipe. The removable drain insert apparatus 10 includes a horizontal floor area 20 having at least one drain hole 22 positioned substantially on a center portion thereof. The removable drain insert apparatus 10 further includes a slightly contoured wall surface 24 extending upwardly from an outer peripheral edge 26 of the horizontal floor area 20 and a funnel portion 28 extending downwardly from the at least one drain hole 22. The funnel portion 28 may be tapered in shape. The funnel portion 28 may be adapted to receive a pipe inlet of a floor sink/sewage ingress to drain water and the horizontal floor area 20 may collect solid waste that can be dumped out during cleaning. The horizontal floor area 20 further includes at least one ridge 32 disposed on a top surface 36 of the horizontal floor area 20 for holding at least one grate. The removable drain insert apparatus 10 further includes at least one hand grip 34 attached to at least one corner portion on the horizontal floor area 20. The horizontal floor area 20 has a depth of at least 2-3 cm. The horizontal floor area 20 is preferably made of a durable rubber or plastic to facilitate conformity to the shape of the surface around the drain pipe, crating a snug fit on a variety of surfaces.

Figure 2:
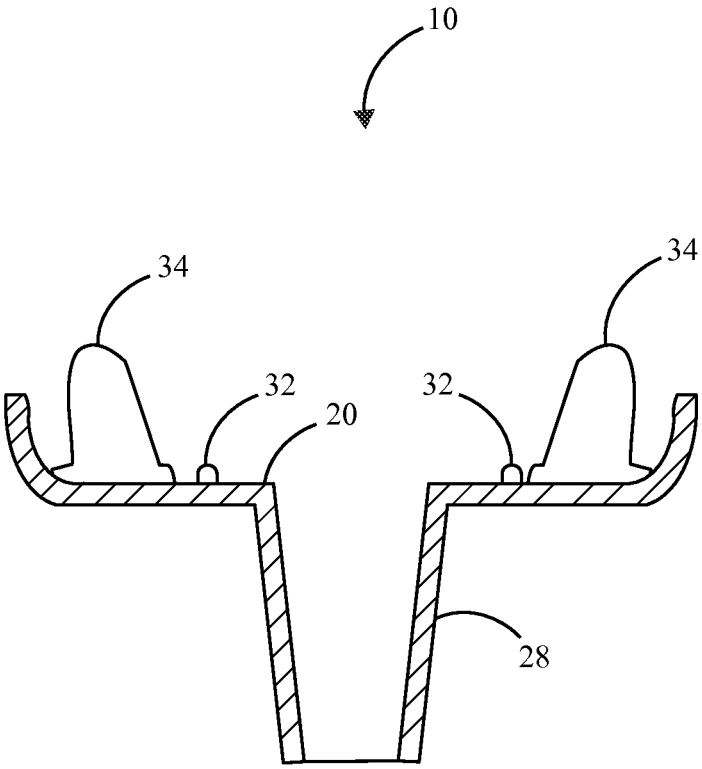
FIG. 2 is a side cross-sectional view of the present invention, partially illustrating a hand grip and at least one ridge.

FIG. 2 is a side cross-sectional view of the removable drain insert apparatus 10. The funnel portion 28 may have a maximum inner cross-sectional area approximately of about 10 $cm^2$. The funnel portion 28 has a minimum inner cross-sectional area approximately of about 8 $cm^2$. The funnel portion 28 may have a minimum length approximately of about 6 cm. The funnel portion 28 may have a maximum length of approximately of about 8 cm. The at least one hand grip 34 may be adaptable to remove the removable drain insert apparatus 10 from the floor sink/sewage ingress when not in use. The horizontal floor area 20, the funnel portion 28 and the at least one hand grip 34 may be made integrally with one another from a single mold. The horizontal floor area 20, the funnel portion 28 and the at least one hand grip 34 may be made separately and coupled together.

Figure 3:
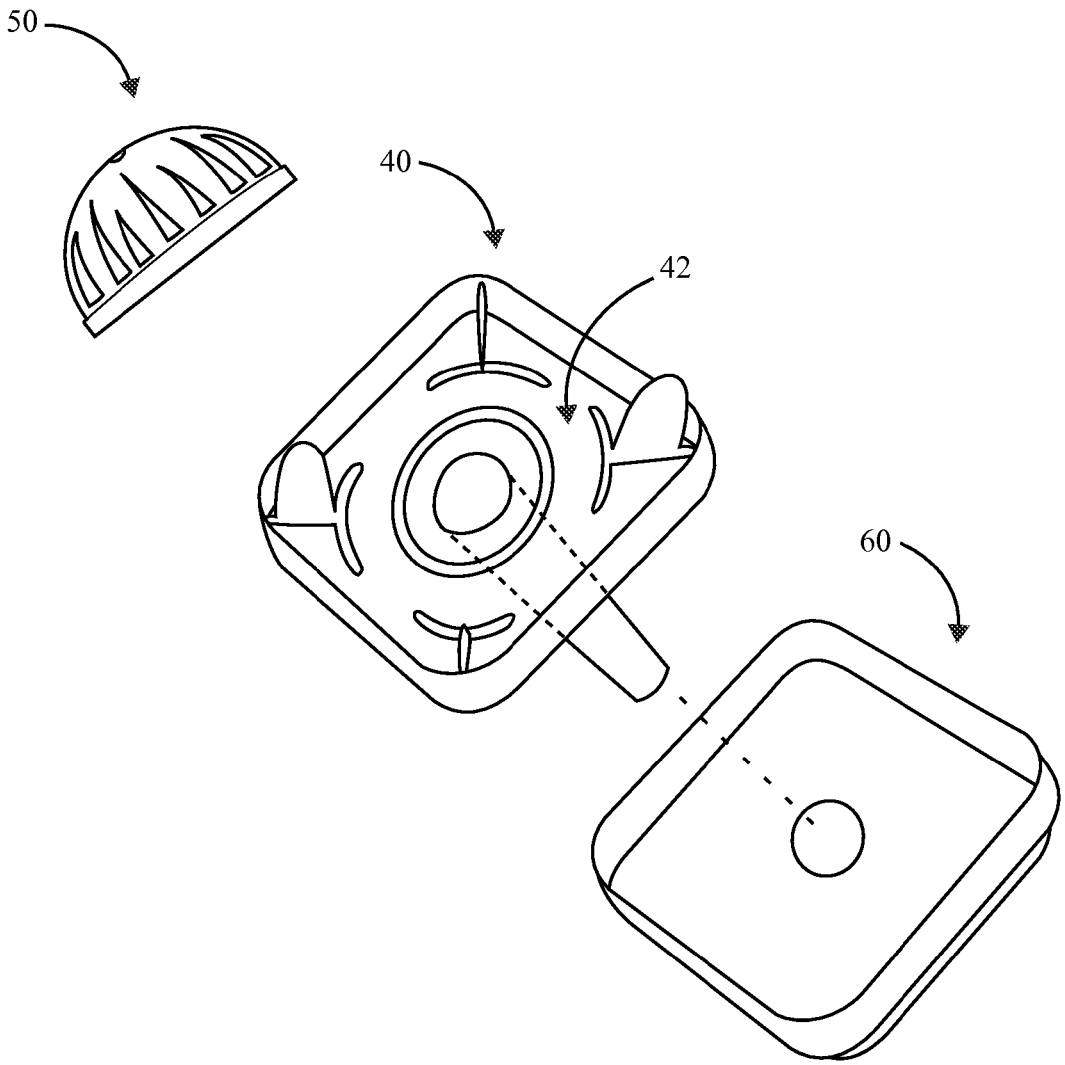
FIG. 3 is an exploded view of another embodiment of the present invention, illustrating the removable drain insert apparatus being positioned over the floor sink/sewage ingress.

FIG. 3 is an exploded view of another embodiment of the present invention, illustrating the removable drain insert apparatus 40 being positioned over the floor sink/sewage ingress 60. The horizontal floor area 42 of the removable drain insert apparatus 40 may be designed to receive at least one grate 50.

While a particular form of the invention has been illustrated and described, it will be apparent that various modifications can be made without departing from the spirit and scope of the invention. For example, the size and depth of the horizontal floor area can be varied. Accordingly, it is not intended that the invention be limited, except as by the appended claims.

What is claimed is:

1. In a drain having at least one substantially hemispherical grate and an ingress for receiving liquid being drained, the improvement comprising:

a removable drain insert apparatus for preventing drain flies from infesting a drain pipe, said insert including:

a horizontal floor area having at least one drain hole positioned substantially on a center portion thereof;

at least one ridge disposed on a top surface of the horizontal floor area for holding at least one grate;

a contoured wall surface extending upwardly from an outer peripheral edge of the horizontal floor area;

at least one hand grip extending upwardly from said horizontal floor area, attached to a corner thereof, said grip being further from said drain hole than said ridge; and an elongate funnel portion extending downwardly from the at least one drain hole into said ingress;

wherein the horizontal floor area and the elongate funnel portion together facilitate the removal of solid waste and water, while preventing drain flies and other insects from entering said drain.

2. The drain of claim 1 wherein the funnel portion is tapered in shape.

3. The drain of claim 1 wherein the funnel portion has a maximum inner cross-sectional area approximately of about 10 $cm^2$.

4. The drain of claim 1 wherein the funnel portion has a minimum inner cross-sectional area approximately of about 8 $cm^2$.

5. The drain of claim 1 wherein the funnel portion has a minimum length approximately of about 6 cm.

6. The drain of claim 1 wherein the funnel portion has a maximum length of approximately of about 8 cm.

7. The drain of claim 1 wherein the horizontal floor area, the funnel portion and the at least one hand grip are integrally molded with one another from a single mold.

8. The drain of claim 1 wherein the horizontal floor area, the funnel portion and the at least one hand grip comprise separate pieces made separately and coupled together.

9. The drain of claim 1 wherein the horizontal floor area, the funnel portion and the at least one hand grip are manufactured from a polymeric material.

10. The drain of claim 9 wherein the polymeric material is rubber or PTFE.

* * * * *